US006997507B2

(12) United States Patent
Rhee

(10) Patent No.: US 6,997,507 B2
(45) Date of Patent: Feb. 14, 2006

(54) RUCKSACK HAVING FOLDING CHAIR

(75) Inventor: Yong Su Rhee, Seoul (KR)

(73) Assignee: Jason Industries Co., Ltd., Seoul (KR)

( * ) Notice: Subject to any disclaimer, the term of this patent is extended or adjusted under 35 U.S.C. 154(b) by 0 days.

(21) Appl. No.: 10/751,891

(22) Filed: Jan. 7, 2004

(65) Prior Publication Data

US 2005/0099039 A1 May 12, 2005

(30) Foreign Application Priority Data

Nov. 11, 2003 (KR) ..... 20-2003-0035293

(51) Int. Cl.
*A47C 13/00* (2006.01)

(52) U.S. Cl. ..... 297/129; 297/188.01; 224/153

(58) Field of Classification Search ..... 297/188.01, 297/188.03, 129; 224/644, 632, 153
See application file for complete search history.

(56) References Cited

U.S. PATENT DOCUMENTS 2,922,465 A * 1/1960 Johansson et al. ..... 224/155
3,622,056 A * 11/1971 Droeger ..... 224/153
4,387,924 A * 6/1983 Fernandez ..... 297/188.01
4,773,574 A * 9/1988 Burgard ..... 224/155
5,419,473 A * 5/1995 Lamar ..... 224/632
5,573,155 A * 11/1996 Sadler ..... 224/153
5,730,347 A * 3/1998 Finot ..... 224/632
5,779,112 A * 7/1998 Krulik ..... 297/129
5,819,999 A * 10/1998 Tennant ..... 224/153
5,927,798 A * 7/1999 Ahn ..... 297/129
5,957,349 A * 9/1999 Krulik ..... 297/129
5,975,626 A * 11/1999 Aycock ..... 297/16.1
6,048,023 A * 4/2000 Lampton ..... 297/129

FOREIGN PATENT DOCUMENTS

JP 11-285407 10/1999
KR 1999-35591 9/1999

* cited by examiner

*Primary Examiner*—Peter M. Cuomo
*Assistant Examiner*—Stephen D'Adamo
(74) *Attorney, Agent, or Firm*—Jacobson Holman PLLC

(57) ABSTRACT

A rucksack having a folding chair. The rucksack includes a back wall, a bag body of a large volume, a plurality of pockets respectively provided at predetermined portions of the bag body and having small volumes, and a pair of shoulder straps. The rucksack further includes a VELCRO releasable fastener having a pile piece and a hook piece constituting a fixed part which is provided at an upper portion of the back wall to have a predetermined area, while also constituting a movable part which is detachably fastened to the fixed part. The folding chair has the movable part of the VELCRO releasable fastener at a predetermined portion thereof, and is longer than the back wall. A cover covers the folding chair while exposing a predetermined portion of the folding chair to an outside, with a slide fastener being provided along each of both side edges of the back wall and an associated side edge of the cover to fasten the cover to the back wall. A spacer is provided on a predetermined position of the cover to contact with the back and a waist of the user, thus spacing the cover from the back and the waist of the user. A spacer guide part extends from an upper portion to a lower portion of the cover.

5 Claims, 5 Drawing Sheets

RUCKSACK HAVING FOLDING CHAIR

BACKGROUND OF THE INVENTION

1. Field of the Invention

The present invention relates generally to a rucksack having a folding chair, and more particularly to a rucksack having a folding chair, which is constructed such that the folding chair is enveloped in the rucksack and taken out from the rucksack when necessary, thus allowing a user to sit on the chair.

2. Description of the Related Art

Generally, a rucksack is used for containing a variety of items therein. Further, a rucksack for women is widely used. However, the rucksack is mainly used while climbing a mountain. The rucksack for mountain-climbing serves as only a bag. Thus, when a user desires to rest during climbing a mountain, the user must sit on an even rock or the ground, thus causing inconvenience to the user, and sometimes making the user suffer from disease, such as piles.

In order to solve the problem, there is proposed Korean Utility Model No. 20-1998-0001193, which was filed with KIPO on Feb. 5, 1998 by the inventor, and is titled "RUCKSACK HAVING FOLDING CHAIR". According to the Korean Utility Model, a pocket is provided on a back wall of the rucksack to be open or closed by slide fasteners which are provided along a bottom edge and side edges of the back wall and associated edges of the pocket. The rucksack further includes a band. The band is sewn, at a first end thereof, on a surface of the back wall inside the pocket. A VELCRO releasable fastener including a pile piece and a hook piece are provided on a second end of the band and a surface of the back wall corresponding to the second end of the band, respectively. Further, another elastic band is fixed on an inside edge of a seat which is integrated with top portions of support legs of the chair, thus forming a loop. The second end of the band having the pile piece of the VELCRO releasable fastener is inserted into the loop, and is fastened to the hook piece of the back wall by the interlocking of the pile piece with the hook piece, thus fastening the chair to the back wall.

However, the conventional rucksack having the folding chair has a problem in that a size of the chair is small when a size of the rucksack may be small, because the chair is enveloped in the back wall. Thus, when a big user sits on the chair of the rucksack, the user must crouch, thus causing inconvenience to the user.

In case of increasing the length of the chair so as to overcome the above-mentioned problem, a ground contact surface of the chair may be covered with dirt, thus having the user's clothes dirty.

SUMMARY OF THE INVENTION

Accordingly, the present invention has been made keeping in mind the above problems occurring in the prior art, and an aspect of the present invention is to provide a rucksack having a folding chair, which is constructed so that the chair has an enough size for a big user to sit thereon, and prevents the user's clothes from getting dirty by a dirty ground contact surface of the chair, regardless of the user's body shape, and evenly distributes a load applied by items contained in the rucksack.

In order to accomplish the above aspect, the present invention provides a rucksack having a back wall to contact with a back of a user, a bag body to have a large volume, a plurality of pockets respectively provided at predetermined portions of the bag body and having small volumes, and a pair of shoulder straps each sewn on upper and lower portions of the back wall so that the user carries the rucksack on shoulders of the user. The rucksack further includes a VELCRO releasable fastener, a folding chair, a cover, a spacer, and a spacer guide part. The VELCRO releasable fastener includes a pile piece and a hook piece, one of the pile piece and the hook piece constituting a fixed part which is provided at an upper portion of the back wall to have a predetermined area, while a remaining one of the pile piece and the hook piece constituting a movable part which is detachably fastened to the fixed part. The folding chair has the movable part of the VELCRO fastener at a predetermined portion thereof, and is longer than the back wall by a predetermined length. The cover covers the folding chair while exposing a predetermined portion of the folding chair to an outside, with a slide fastener being provided along each of both side edges of the back wall and an associated side edge of the cover to fasten the cover to the back wall. The spacer is provided on a predetermined position of the cover to contact with the back and a waist of the user, thus spacing the cover from the back and the waist of the user to prevent the exposed portion of the folding chair from contacting with a body of the user. The spacer guide part extends from an upper portion to a lower portion of the cover, with the spacer mounted to the spacer guide part so as to move along the spacer guide part.

The rucksack further includes a spacer holder to hold the spacer at a desired position relative to the spacer guide part. The spacer holder includes a VELCRO releasable fastener comprising a pile piece and a hook piece. One of the pile piece and the hook piece is provided on a surface of the back wall along a position corresponding to an inner surface of the spacer guide part, and a remaining one of the pile piece and the hook piece is provided on a portion of the spacer which contacts with the surface of the back wall.

The spacer is transversely placed on the cover, and has preferably a cushion member therein to distribute a load of the bag body. A position of the spacer is adjusted along the spacer guide part.

The folding chair further includes a pair of frames, a seat, a folding motion guide unit, and a hinge shaft. The pair of frames are provided to be longer than the cover, and cross each other to form a folding chair frame. Each of the pair of frames has a rectangular shape. The seat is integrated at both edges thereof with top portions of the pair of frames, and has either the pile piece or the hook piece of the VELCRO releasable fastener at one of the edges of the seat, with the folding chair frame being open to allow the user to sit on the seat, and being closed when the chair is not in use. The folding motion guide unit is provided on each of the pair of frames at intersections where the pair of frames cross each other to form the folding chair frame, thus guiding a folding motion of the folding chair frame. The hinge shaft is provided at each of the intersections where the folding motion guide units of the pair of frames cross each other, thus joining the pair of frames to each other.

A chair holding member is provided at a predetermined portion of the back wall to movably hold a portion of the folding chair, thus preventing the folding chair from being removed from the back wall. The chair holding member is fastened at opposite ends thereof to each other using a VELCRO releasable fastener, thus forming a closed loop.

BRIEF DESCRIPTION OF THE DRAWINGS

The above and other aspects, features and other advantages of the present invention will be more clearly understood from the following detailed description taken in conjunction with the accompanying drawings, in which.

DESCRIPTION OF THE PREFERRED EMBODIMENTS

Figure 1:
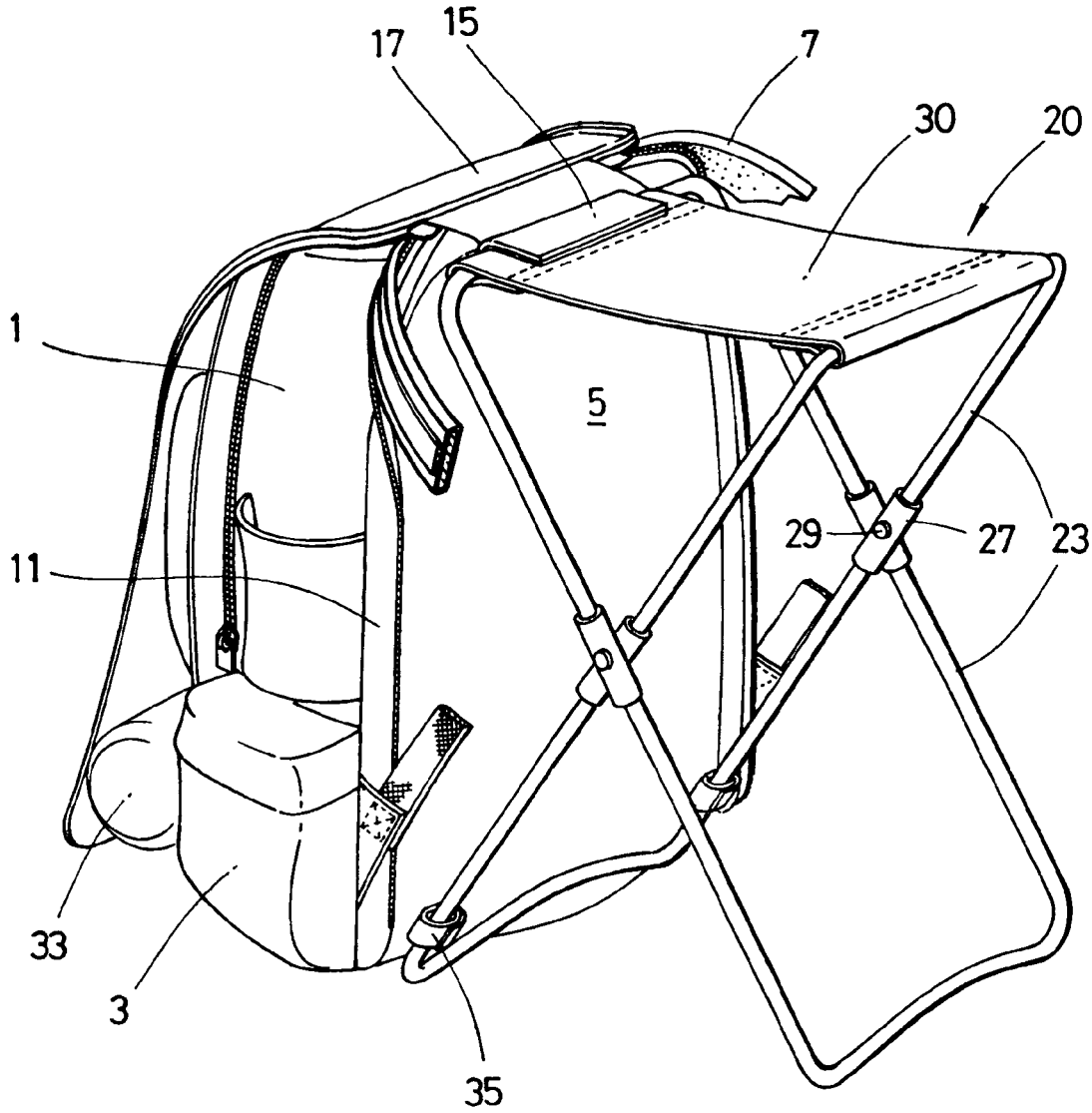
FIG. 1 is a perspective view of a rucksack having a folding chair, according to the present invention, with a cover of the rucksack being open.

Hereinafter, embodiments of the present invention will be described in detail with reference to the attached drawings.

Reference now should be made to the drawings, in which the same reference numerals are used throughout the different drawings to designate the same or similar components.

Figure 2:
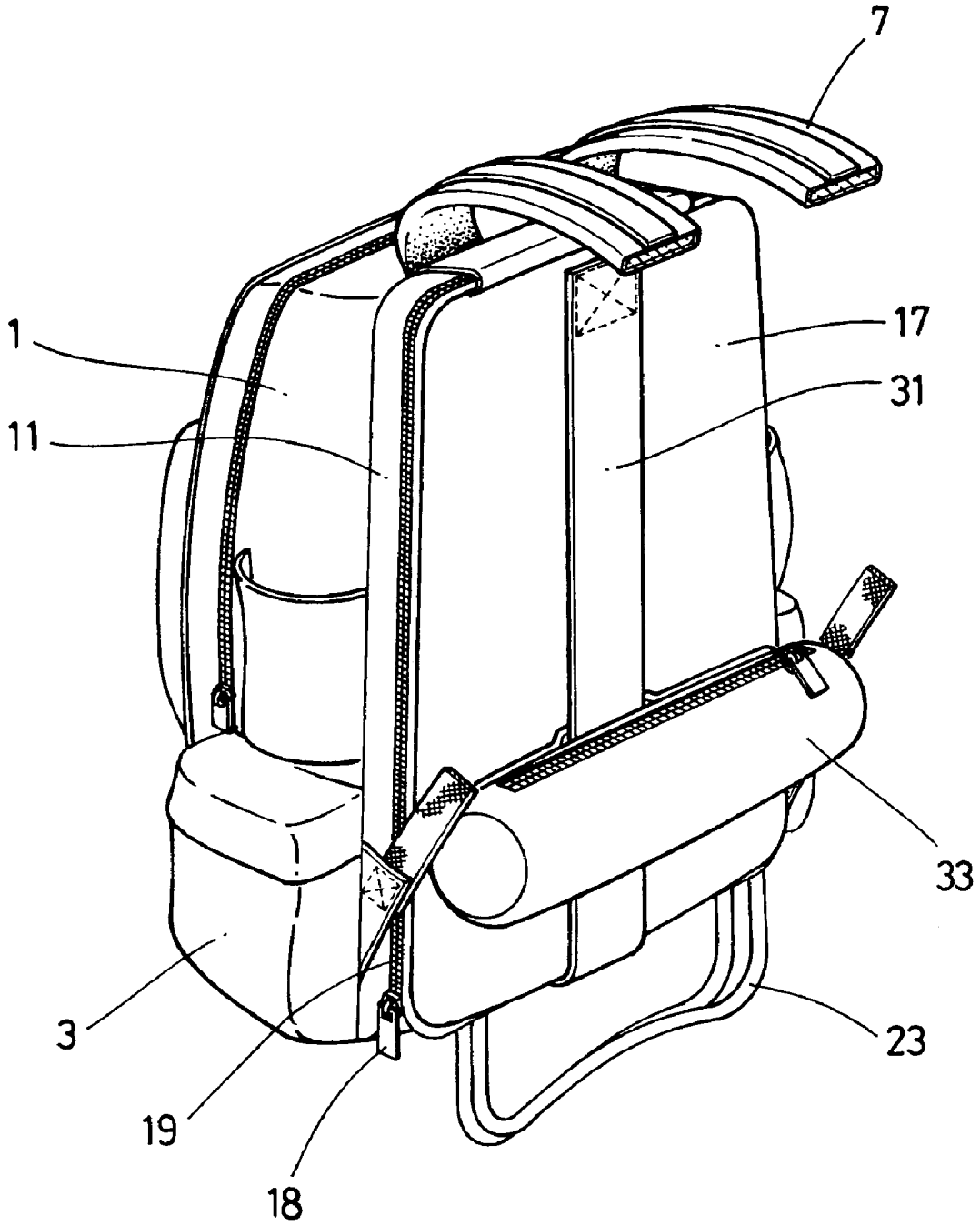
FIG. 2 is a perspective view of the rucksack of FIG. 1, when the cover is closed to cover the chair.
Figure 3:
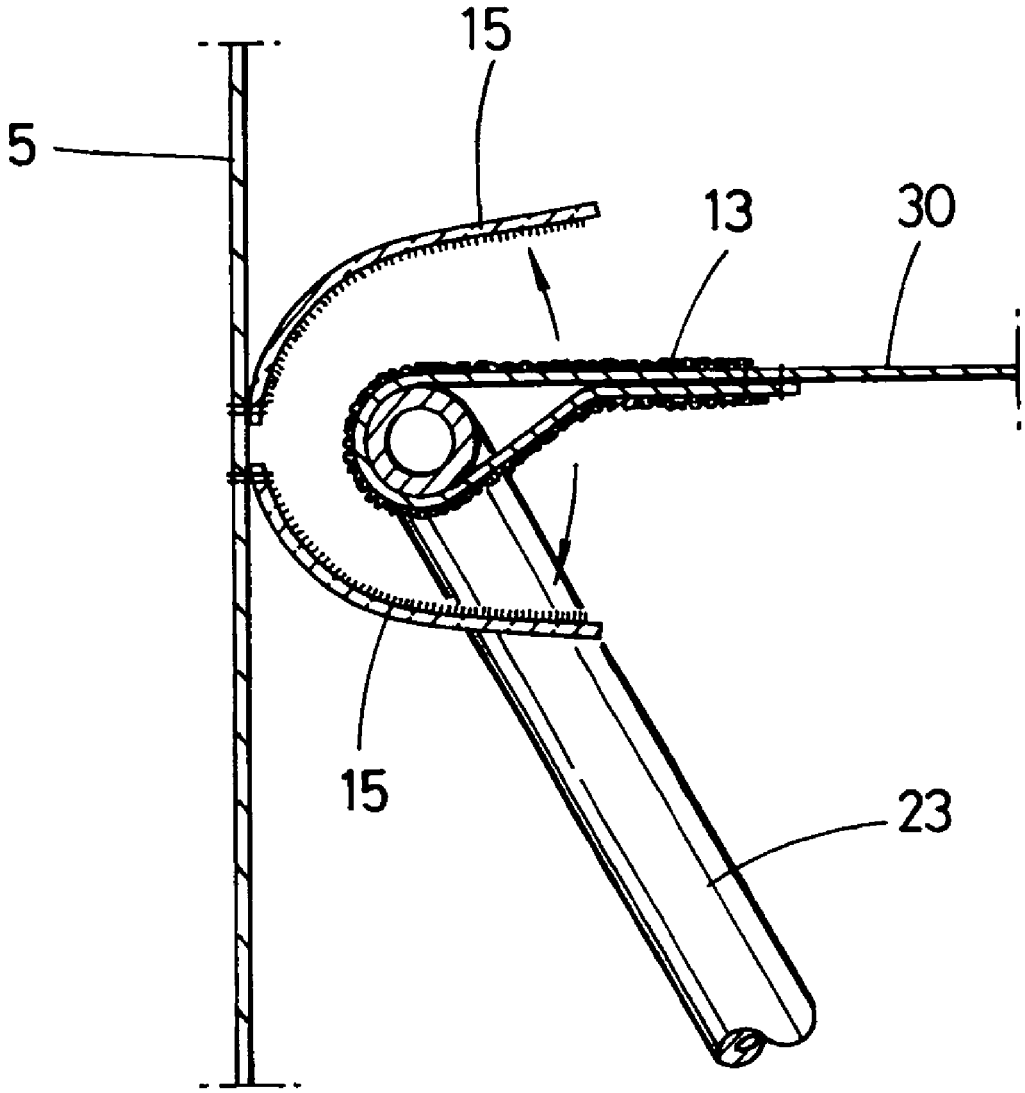
FIG. 3 is a side sectional view of the rucksack of FIG. 1, when the folding chair is fastened to a back wall of the rucksack using a Velcro fastener.
Figure 4:
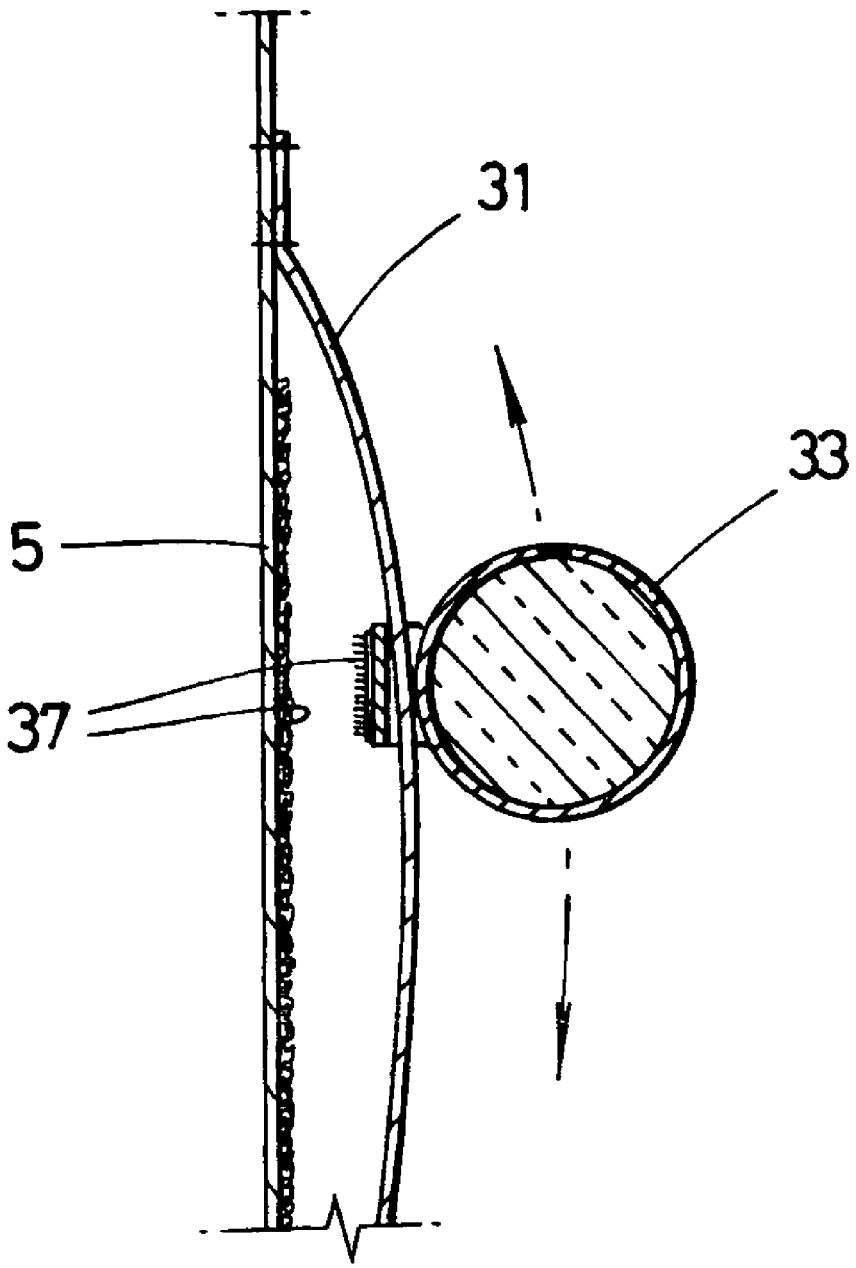
FIG. 4 is a side sectional view of the rucksack of FIG. 1, when a spacer of the rucksack moves along a spacer guide part.
Figure 5:
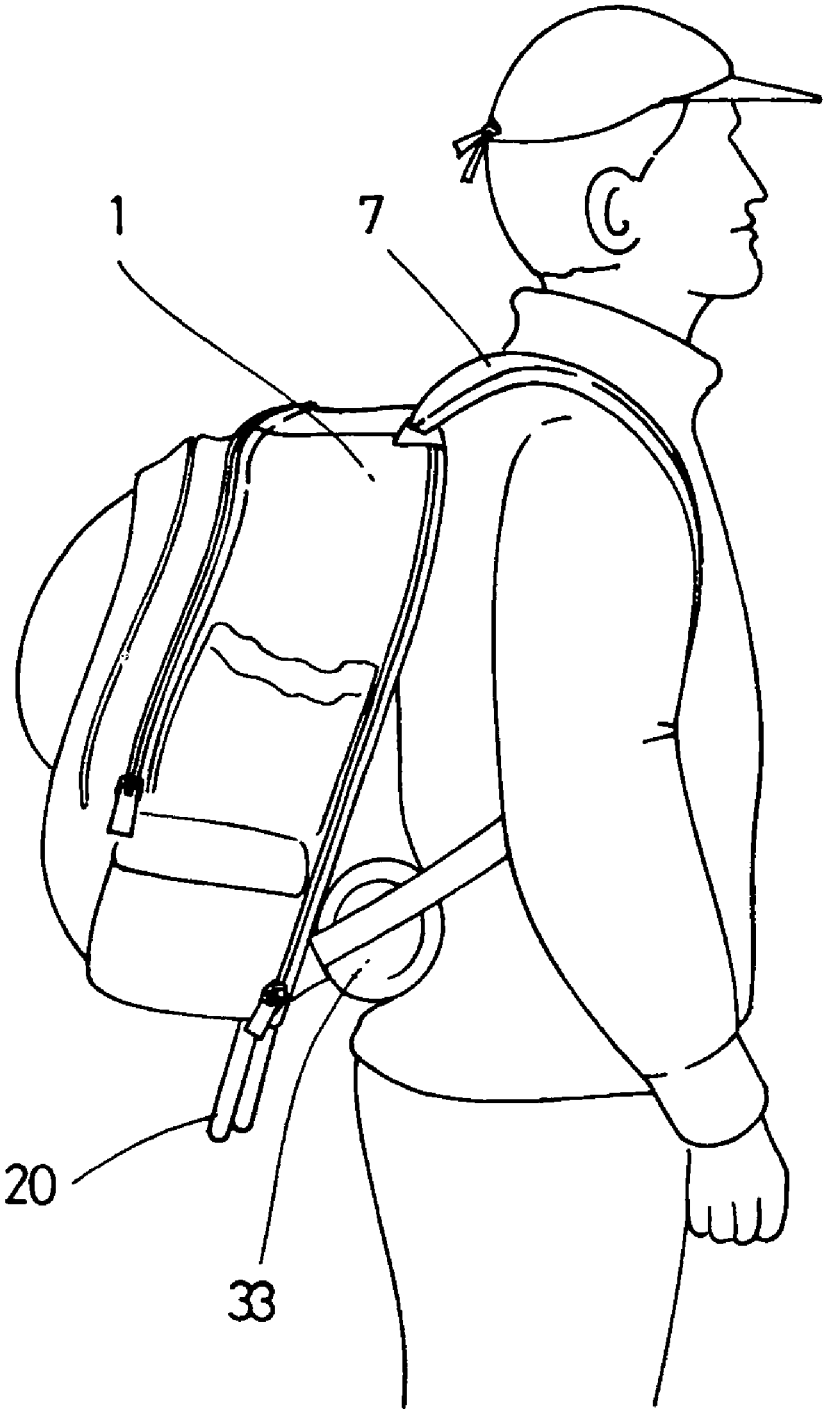
FIG. 5 is a side view of the rucksack of FIG. 1 which is carried on user's shoulders.

FIG. 1 is a perspective view of a rucksack having a folding chair, according to the present invention, with a cover of the rucksack being open. FIG. 2 is a perspective view of the rucksack of FIG. 1, when the cover is closed to cover the chair. FIG. 3 is a side sectional view of the rucksack of FIG. 1, when the folding chair is fastened to a back wall of the rucksack using a VELCRO releasable fastener. FIG. 4 is a side sectional view of the rucksack of FIG. 1, when a spacer of the rucksack moves along a spacer guide part. FIG. 5 is a side view of the rucksack of FIG. 1 which is carried on user's shoulders.

As shown in FIGS. 1 and 2, the rucksack according to the present invention includes a back wall 5 which contacts with a back of a user, and a bag body 1 having a large volume. A plurality of pockets 3 are respectively provided at predetermined portions of the bag body 1 and have small volumes.

A pair of shoulder straps 7 each are provided on a predetermined portion of the bag body 1 to extend from an upper portion to a lower portion of the bag wall 5 so that the user carries the rucksack on the user's shoulders. An adjustable buckle (not shown) is provided at a predetermined portion of each of the shoulder straps 7 to adjust a length of each of the shoulder straps 7 according to the user's size.

Further, guides 11 are provided along both side edges of the back wall 5 to define a space which receives a folding chair 20. As shown in FIG. 3, a U-shaped hook piece 15 of a VELCRO releasable fastener is provided at a center of an upper portion of the back wall 5. The U-shaped hook piece 15 comprises two hook pieces separately sewn on the back wall 5. A cover 17 is sewn on the upper portion of the back wall 5 to cover the back wall 5, thus defining the space which receives the folding chair 20, in cooperation with the guides 11. Thereby, the folding chair 20 is received in the space which is defined by the cover 17 and the back wall 5. The folding chair 20 includes a seat 30 on which the user sits. At one of edges of the seat 30 is sewn a pile piece 13 of the VELCRO releasable fastener to interlock with the hook piece 15 of the back wall 5. Thus, the folding chair 20 is detachably fastened to the back wall 5, by a selective interlocking of the hook piece 15 of the back wall 5 with the pile piece 13 of the seat 30.

Further, teeth 19 of slide fasteners are provided along side edges of the cover 17 and associated edges of the guides 11. The teeth 19 of the cover 17 and the teeth 19 of the guides 11 engage with or disengage from each other by sliding tabs 18 to be closed or open. Even when the back wall 5 is covered with the cover 17 by the slide fasteners, a bottom edge of the cover 17 is open.

The folding chair 20 includes a pair of frames, 23, the seat 30, folding motion guide units 27, and hinge shafts 29. The pair of frames 23 are provided to be longer than the cover 17, and cross each other to form a folding chair frame. Each of the pair of frames 23 has a rectangular shape. The seat 30 is integrated at both edges thereof with top portions of the pair of frames 23, and has the pile piece 13 of the VELCRO fastener at the edge of the seat 30. The folding chair frame is open to allow the user to sit on the seat 30, and is closed when the chair 20 is not in use. Each of the folding motion guide units 27 is provided on each of the pair of frames 23 at intersections where the pair of frames 23 cross each other to form the folding chair frame, thus guiding a folding motion of the folding chair frame. Each of the hinge shafts 29 is provided at each of the intersections where the folding motion guide units 27 of the pair of frames 23 cross each other, thus joining the pair of frames 23 to each other. A bottom of each of the frames 23 is upward rounded, thus allowing the frames 23 to stably stand on a support surface.

A spacer guide part 31 extends from an upper portion to a lower portion of the cover 17. The spacer guide part 31 is sewn at a first end thereof on a predetermined portion of the cover 17. Further, one of a pile piece and a hook piece is provided at a second end of the spacer guide part 31, while a remaining one of the pile piece and the hook piece is provided at a position of the cover 17 corresponding to the second end of the spacer guide part 31. The rucksack of the present invention includes a spacer 33. The spacer 33 is movably fitted over the spacer guide part 31 through the second end of the spacer guide part 31 which is selectively detached from the cover 17. The spacer 33 is provided on a predetermined position of the cover 17 to contact with the back and a waist of the user. The spacer 33 thus spaces the cover 17 from the back and the waist of the user to prevent an exposed lower portion of the folding chair 20 from contacting with a body of the user. Such a construction allows the spacer 33 to easily move to a desired position along the spacer guide part 31. Preferably, the spacer 33 has a cushion member therein to distribute a load of the bag body 1.

Two chair holding members 35 are provided at predetermined portions of the back wall 5 to movably hold a portion of the folding chair 20, thus preventing the folding chair 20 from being removed from the back wall 5. Each of the chair holding members 35 is fastened at opposite ends thereof to each other using a VELCRO releasable fastener, thus forming a closed loop.

The rucksack of the present invention further includes a spacer holder 37 to hold the spacer 33 at a desired position relative to the spacer guide part 31. As shown in FIG. 4, the spacer holder 37 includes a VELCRO releasable fastener comprising a pile piece and a hook piece. In this case, one of the pile piece and the hook piece is provided on a surface of the back wall 5 along a position corresponding to an inner surface of the spacer guide part 31, and a remaining one of the pile piece and the hook piece is provided on a portion of the spacer 33 which contacts with the surface of the back wall 5.

The rucksack having the folding chair 20 according to the present invention is useful to a big user. As shown in FIG. 5, when the rucksack is carried on the user's shoulders using the shoulder straps 7, a portion of the folding chair 20 which is relatively long, is exposed to an outside. The exposed portion of the folding chair 20 may be covered with dirt, thus having the user's clothes dirty. However, the rucksack of the present invention is provided with the spacer 33, thus spacing the dirty exposed portion of the folding chair 20 from the user's body when the spacer 33 is held at a desired position relative to the spacer guide part 31. Therefore, the spacer 33 prevents the user's clothes from getting dirty, and distributes evenly a load applied to the user's back and waist by items contained in the bag body 1, thus reducing fatigue of the user.

As described above, the present invention provides a rucksack having a folding chair, which is constructed such that the chair has an enough size for a big user to sit thereon, prevents the user's clothes from getting soiled by a dirty ground contact surface of the chair, regardless of the user's body shape, and evenly distributes a load applied by items contained in the rucksack, thus maximizing convenience.

Further, the rucksack having the folding chair according to the present invention can be adjusted according to sizes of users, thus being used for both small and big users.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A rucksack including a back wall, a bag body and a pair of shoulder straps on upper and lower portions of the back wall so that the user carries the rucksack on shoulders of the user, the rucksack comprising:

a releasable fastener comprising a pile piece and a hook piece, one of the pile piece and the hook piece constituting a fixed part which is provided at an upper portion of the back wall to have a predetermined area, while a remaining one of the pile piece and the hook piece constituting a movable part which is detachably fastened to the fixed part;

a folding chair having the movable part of the releasable fastener at a predetermined portion thereof, the folding chair being longer than the back wall by a predetermined length;

a cover to cover the folding chair, a length of the cover and a length of the bag body being less than a length of the folding chair to expose a predetermined portion of the folding chair to an outside, with a slide fastener being provided along each of both sides edges of the back wall and an associated side edge of the cover to fasten the cover to the back wall;

a spacer provided on a predetermined position of the cover to contact with the back and a waist of the user, the spacer thus spacing the cover from the back and the waist of the user to prevent the exposed portion of the folding chair from contacting with a body of the user; and a spacer guide part extending from an upper portion to a lower portion of the cover, with the spacer mounted to the spacer guide part so as to move along the spacer guide part.

2. The rucksack according to claim 1, wherein the spacer is transversely placed on the cover, and has a cushion member therein to distribute a load of the bag body, with a position of the spacer being adjusted along the spacer guide part.

3. The rucksack according to claim 1, wherein the folding chair comprises:

a pair of frames provided to be longer than the cover, each of the pair of frames having a rectangular shape, the pair of frames crossing each other to form a folding chair frame;

a seat integrated at both edges thereof with top portions of the pair of frames, and having either the pile piece or the hook piece of the releasable fastener at one of the edges of the seat, with the folding chair frame being open to allow the user to sit on the seat, and being closed when the chair is not in use;

a folding motion guide unit provided on each of the pair of frames at intersections where the pair of frames cross each other to form the folding chair frame, thus guiding a folding motion of the folding chair frame; and a hinge shaft provided at each of the intersections where the folding motion guide units of the pair of frames cross each other, the hinge shaft thus joining the pair of frames to each other.

4. The rucksack according to claim 1, wherein a chair holding member is provided at a predetermined portion of the back wall to movably hold a portion of the folding chair, thus preventing the folding chair from being removed from the back wall, the chair holding member being fastened at opposite ends thereof to each other using a releasable fastener, thus forming a closed loop.

5. The rucksack according to claim 1, further comprising:

a spacer holder to hold the spacer at a desired position relative to the spacer guide part, the spacer holder comprising another releasable fastener comprising a pile piece and a hook piece, one of the pile piece and the hook piece being provided on a surface of the back wall along a position corresponding to an inner surface of the spacer guide part, and a remaining one of the pile piece and the hook piece being provided on a portion of the spacer which contacts with the surface of the back wall.

* * * * *